US009403618B2

(12) United States Patent
Dolby et al.

(10) Patent No.: US 9,403,618 B2
(45) Date of Patent: Aug. 2, 2016

(54) SEALABLE CARTON WITH HANDLE

(71) Applicants: Luke Dolby, Bergenfield, NJ (US); Valentino Capone, Avondale, AZ (US); James Richard Gagnon, West Springfield, MA (US)

(72) Inventors: Luke Dolby, Bergenfield, NJ (US); Valentino Capone, Avondale, AZ (US); James Richard Gagnon, West Springfield, MA (US)

(73) Assignee: LeisurePAK Inc., Bergenfield, NJ (US)

( * ) Notice: Subject to any disclaimer, the term of this patent is extended or adjusted under 35 U.S.C. 154(b) by 0 days.

(21) Appl. No.: 14/506,231

(22) Filed: Oct. 3, 2014

(65) Prior Publication Data

US 2015/0021381 A1 Jan. 22, 2015

Related U.S. Application Data

(63) Continuation-in-part of application No. PCT/US2013/035392, filed on Apr. 5, 2013.

(60) Provisional application No. 61/808,429, filed on Apr. 4, 2013, provisional application No. 61/793,403, filed on Mar. 15, 2013, provisional application No. 61/620,887, filed on Apr. 5, 2012.

(51) Int. Cl.

| | |
|---|---|
| ***B65D 5/468*** | (2006.01) |
| ***B65D 5/56*** | (2006.01) |
| ***B65D 5/74*** | (2006.01) |
| ***B65D 5/46*** | (2006.01) |
| ***B65D 5/06*** | (2006.01) |

(52) U.S. Cl.

CPC ..... *B65D 5/4608* (2013.01); *B65D 5/067* (2013.01); *B65D 5/46096* (2013.01); *B65D 5/563* (2013.01); *B65D 5/742* (2013.01); *B65D 2101/0023* (2013.01)

(58) Field of Classification Search

USPC ..... 229/213, 136, 5.83, 117.17

See application file for complete search history.

(56) References Cited

U.S. PATENT DOCUMENTS

| | | | | |
|---|---|---|---|---|
| 1,160,677 | A | 11/1915 | Van Wormer | |
| 2,412,666 | A | 12/1946 | Zinn, Jr. | |
| 2,417,104 | A * | 3/1947 | Cope | B65D 5/068 229/213 |
| 2,514,858 | A | 3/1948 | Gray | |
| 2,661,138 | A * | 12/1953 | Leonard | B65D 5/068 229/106 |
| 2,675,264 | A | 4/1954 | Lugt, Jr. | |
| 2,782,915 | A | 2/1957 | Fahringer | |
| RE25,021 | E | 8/1961 | Alden | |
| 3,217,966 | A | 11/1965 | Kelly | |
| 3,291,369 | A | 12/1966 | Crawford | |
| 3,297,350 | A | 1/1967 | Hidding | |
| 3,301,586 | A | 1/1967 | Lisiecki | |
| 3,452,919 | A | 7/1969 | Avolio | |
| 3,701,558 | A | 10/1972 | Baker | |

(Continued)

OTHER PUBLICATIONS

International Search Report & Written Opinion Application No. PCT/US2013/035392 Completed: Jun. 18, 2013; Mailing Date: Jun. 28, 2013 pp. 9.

*Primary Examiner* — Christopher Demeree

(74) *Attorney, Agent, or Firm* — St. Onge Steward Johnston & Reens LLC

(57) ABSTRACT

A carton for transporting and dispensing liquid-based materials including a sealed base, upwardly tapered sides, and a top portion with a gable top and a sealing portion to close the top portion. The sealing portion includes a perforation to permit the top portion to be opened. A tamper-proof seal is on the sealing portion revealing tamper evidence upon opening of the top portion of the carton. A handle of the carton includes two handle loops.

20 Claims, 21 Drawing Sheets

(56) References Cited

U.S. PATENT DOCUMENTS

| | | | |
|---|---|---|---|
| 3,722,782 | A | 3/1973 | Collie |
| 4,032,060 | A | 6/1977 | Bergstein |
| 4,049,122 | A | 9/1977 | Maxwell |
| 4,214,697 | A | 7/1980 | Manning |
| 4,333,569 | A | 6/1982 | Hammacher |
| 4,498,585 | A | 2/1985 | Gordon et al. |
| 4,646,961 | A | 3/1987 | Wald |
| 4,714,164 | A | 12/1987 | Bachner |
| 4,761,156 | A | 8/1988 | Bachner et al. |
| 4,813,547 | A | 3/1989 | Wyberg |
| 4,869,373 | A | 9/1989 | Wyberg |
| 4,872,562 | A | 10/1989 | Wyberg |
| 5,076,493 | A | 12/1991 | Anderson |
| 5,513,753 | A | 5/1996 | Jensen |
| 5,518,117 | A | 5/1996 | Eriksen |
| 5,683,339 | A | 11/1997 | Mills et al. |
| 5,772,109 | A | 6/1998 | Phipps |
| 5,816,487 | A | 10/1998 | Skinner |
| 6,341,692 | B1 | 1/2002 | Miller |
| 6,616,033 | B1 | 9/2003 | Schein |
| 6,648,217 | B2 | 11/2003 | Schein |
| 7,891,543 | B2 | 2/2011 | Abel et al. |
| 2008/0023534 | A1 | 1/2008 | Huth et al. |

* cited by examiner

SEALABLE CARTON WITH HANDLE

FIELD OF THE INVENTION

The invention relates to consumer packaging, and more specifically to a single-use carton for transporting beverages and other items.

BACKGROUND OF THE INVENTION

While the present invention has wide industry applicability, it is particularly useful for transporting take-out beverages dispensed at retail food and drink establishments such as stores, restaurants, and breweries.

Many breweries and brewpubs allow patrons to take home draft beer, and the typical means of doing so is with a growler. A growler is a glass or ceramic jug which may be sold or loaned to patrons by the brewery and filled with beer from a tap at the brewery. A drawback of a growler is that it often must be purchased for an additional fee or returned to the brewery. Growlers also generally have a screw-on cap or a hinged porcelain gasket cap, which may be opened and closed without limitation. Growlers do not include any means to close the growler in a semi-permanent or tamper proof manner. Thus, in jurisdictions having laws prohibiting an open carton of alcohol, it is not possible to show that the growler remained closed during transportation.

What is desired therefore is an improved means for transporting beverages and other items.

SUMMARY OF THE INVENTION

Accordingly, it is an object of the present invention to provide a carton for transporting beverages and other items with a tamper-proof seal. It is also an object of the present invention to provide a carton that is adapted for single use and is disposable and/or bio-degradable.

These and other objects of the present invention are achieved by means of a carton including a sealed based, tapered sides, and a top portion with a tamper-proof seal. In a preferred embodiment, the seal includes an adhesive or tape disposed between two surfaces of the top portion. Once closed, the seal cannot readily be opened without damaging the top portion of the carton. In particular, opening the tamper-proof seal reveals evidence of tamper. In some embodiments, the carton is comprised of a cardboard material with a film or coating on at least one side, such as a polyethylene coating.

Further provided is a carton including handle to transport the carton. The handle includes flaps that fold under the gables of the carton and an opening to receive the top portion or flap of the carton. In some embodiments, the opening of the handle includes a serrated edge or holes which cooperate with the top portion or flap of the carton to secure the handle. In some embodiments, the carton may be at least partially opened and the contents dispensed with the handle in place.

In some embodiments, the top portion of the carton includes a plurality of embossed lines or detents which, upon assembly, cooperate with one another to prevent spillage out of the top of the carton. The carton may also include embossed lines or detents on the tapered sides which provide a fill line for the contents.

Further provided is a carton for transporting and dispensing liquid-based materials, including a sealed base, a plurality of upwardly tapered sides, and a top portion configured to adopt an open configuration for filing the carton and a closed configuration for transporting the liquid-based materials. The top portion includes a top sealing edge and two gables extending outward from the carton in the closed configuration. The carton further includes a seal extending around an interior of the top sealing edge, the seal revealing tamper evidence upon opening of the top portion of the carton from the closed configuration, a handle integrated with the top sealing edge and including two handle loops, and a tear-away portion including a portion of the top sealing edge and a portion of one of the outwardly extending gables. The tear-away portion is separable from the container by perforations to create an opening for dispensing the liquid-based materials.

Other objects of the invention and its particular features and advantages will become more apparent from consideration of the following drawings and accompanying detailed description.

DETAILED DESCRIPTION OF THE INVENTION

Figure 1:
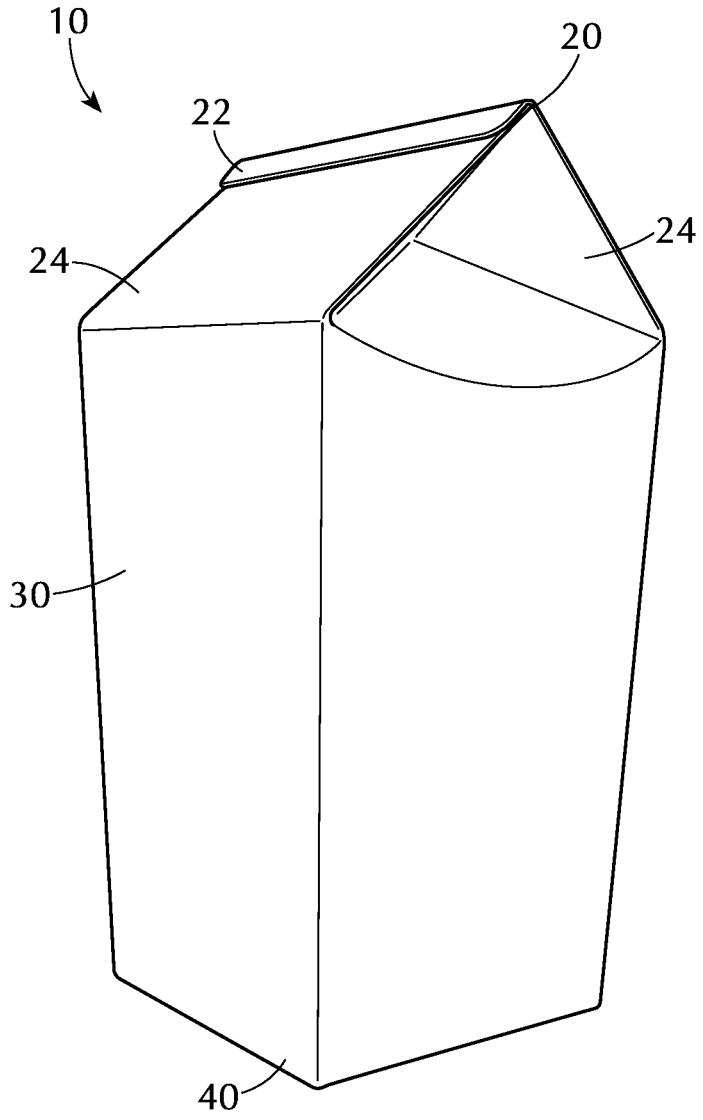
FIG. 1 shows a carton according to an exemplary embodiment of the present invention in an assembled and sealed configuration.

FIG. 1 shows a carton 10 according to an exemplary embodiment of the present invention in an assembled and sealed configuration. In the exemplary embodiment, the carton 10 is comprised of a biodegradable cardboard material. The cardboard material may have a polyethylene layer or coating on one or both sides.

The carton 10 includes a top portion 20 including two gables 24 having exterior panels and interior panels. The top portion 20 also includes a fold-over flap 22 extending from an end of one of the gables 24. In a preferred embodiment, the flap 22 includes a perforated separation line to permit a portion of the flap to be torn or unsealed (e.g., to create open a pouring spout on one side of the carton 10). The carton 10 further includes four upwardly tapered side panels 30.

Figure 2:
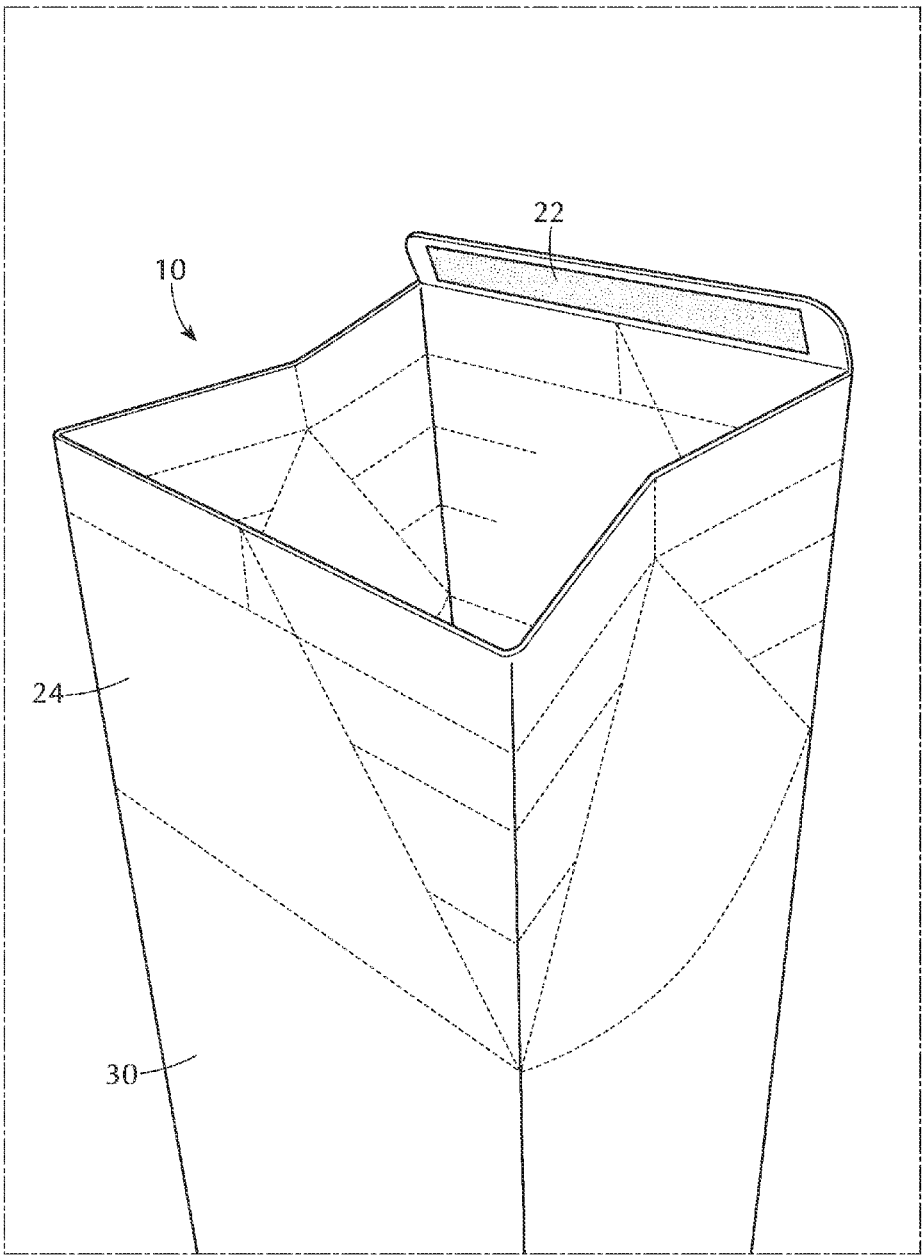
FIG. 2 shows a carton according to an exemplary embodiment of the present invention in an assembled and open configuration prior to use.

As shown in FIG. 2, the top portion 20 of the carton 10 is open prior to use. A plurality of cartons 10 may be stored together in this configuration before use. The tapered design permits several cartons 10 to be stack one inside the other, such that a large number of empty cartons 10 may be stored in a small space (e.g., in a restaurant or bar).

After filling the carton 10, the gables 24 are folded inward and the flap 22 is sealed down against one of the gables 24. The carton 10 may then be transported with the contents enclosed. To dispense the contents, one of the two sides of the flap (22*a* or 22*b* shown in FIG. 3A) may be unsealed and a gable end opened up to create a pouring spout. Alternatively, the entire flap 22 may be unsealed to open the entire top of the carton 10.

The carton 10 is suitable for containing food and cold beverages, as well as non-food applications, and includes a sealing strip mechanism under the flap 22 which provides tamper evidence upon opening. The carton 10 is designed for, though not limited to, single use transportation. For example, the carton 10 may be used to transport beverages, liquid-based foods (e.g., Chinese food, seafood, etc.), paints, and even solid foods and materials. In a preferred embodiment, the carton 10 is used for transporting beer or other alcoholic beverages.

Figure 3A:
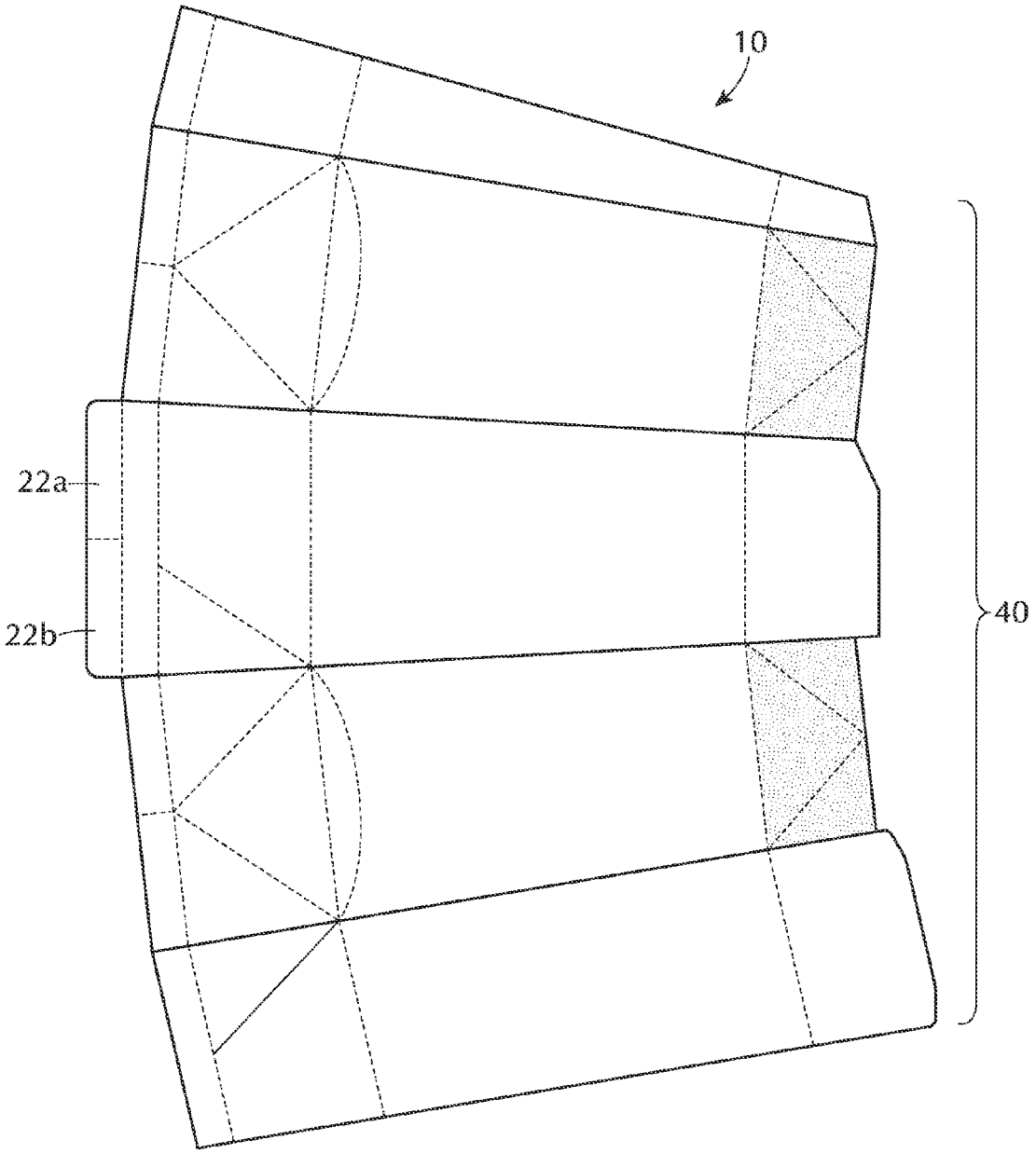
FIG. 3A shows a carton according to an exemplary embodiment of the present invention in an unassembled configuration.

The carton further includes a base 40. As shown in FIG. 3A, the base 40 is formed by a plurality of panels which are folded together. The base 40 is sealed such that it is watertight and able to retain liquids in the carton 10.

In one exemplary embodiment, the watertight seal of the base 40 is formed by a hot melt sealing process. For example, the base panels of the carton 10 may be assembled and held over a stream of air that has been pre-heated to a pre-set temperature (e.g., 360 C). This melts the very fine film of polyethylene coating on the inside of the cardboard flaps. The carton 10 then travels over a water-cooled former (plough) which orients the flaps of the carton 10 and pushes them to an almost horizontal plane so that they are correctly aligned and folded one inside the other. The carton 10 then rests on a plate which is then raised to a set value by taking pressure off of pre-stressed springs. The plate has raised stake-points that correspond with the sealing points required to seal the base of the carton 10. This process is only exemplary, and other means for forming a watertight seal on the base 40 may be employed.

Figure 3B:
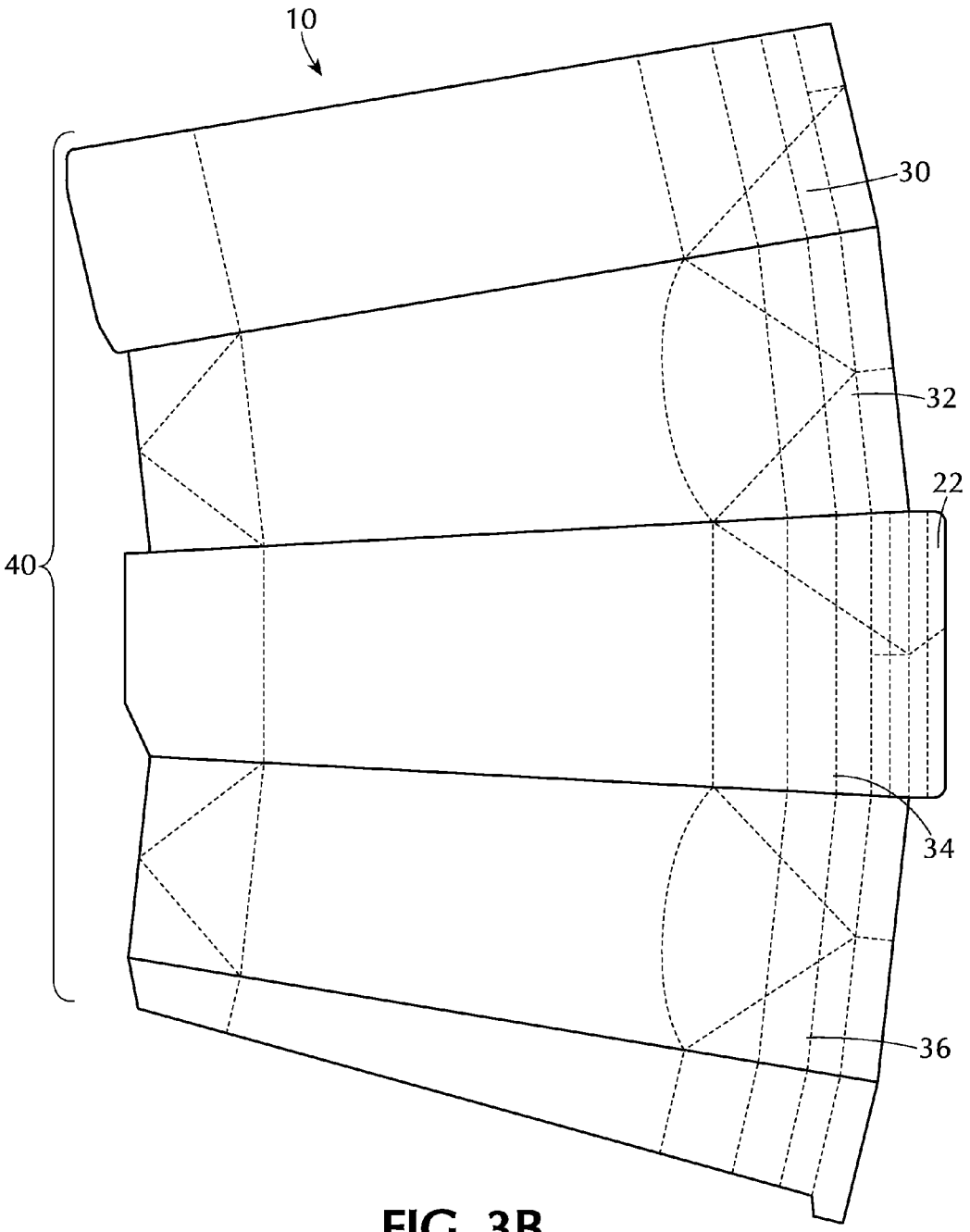
FIG. 3B shows another carton according to an exemplary embodiment of the present invention in an unassembled configuration.

As shown in FIG. 3B, the carton may also include a plurality of embossed lines or detents (30, 32, 34, 36) in the panels of the top portion 20. The embossed lines or detents are also shown in FIG. 2. When the container is assembled, the lines or detents may abut one another and create an improved seal to prevent liquid from spilling out of the corners of the top portion 20.

Figure 3C:
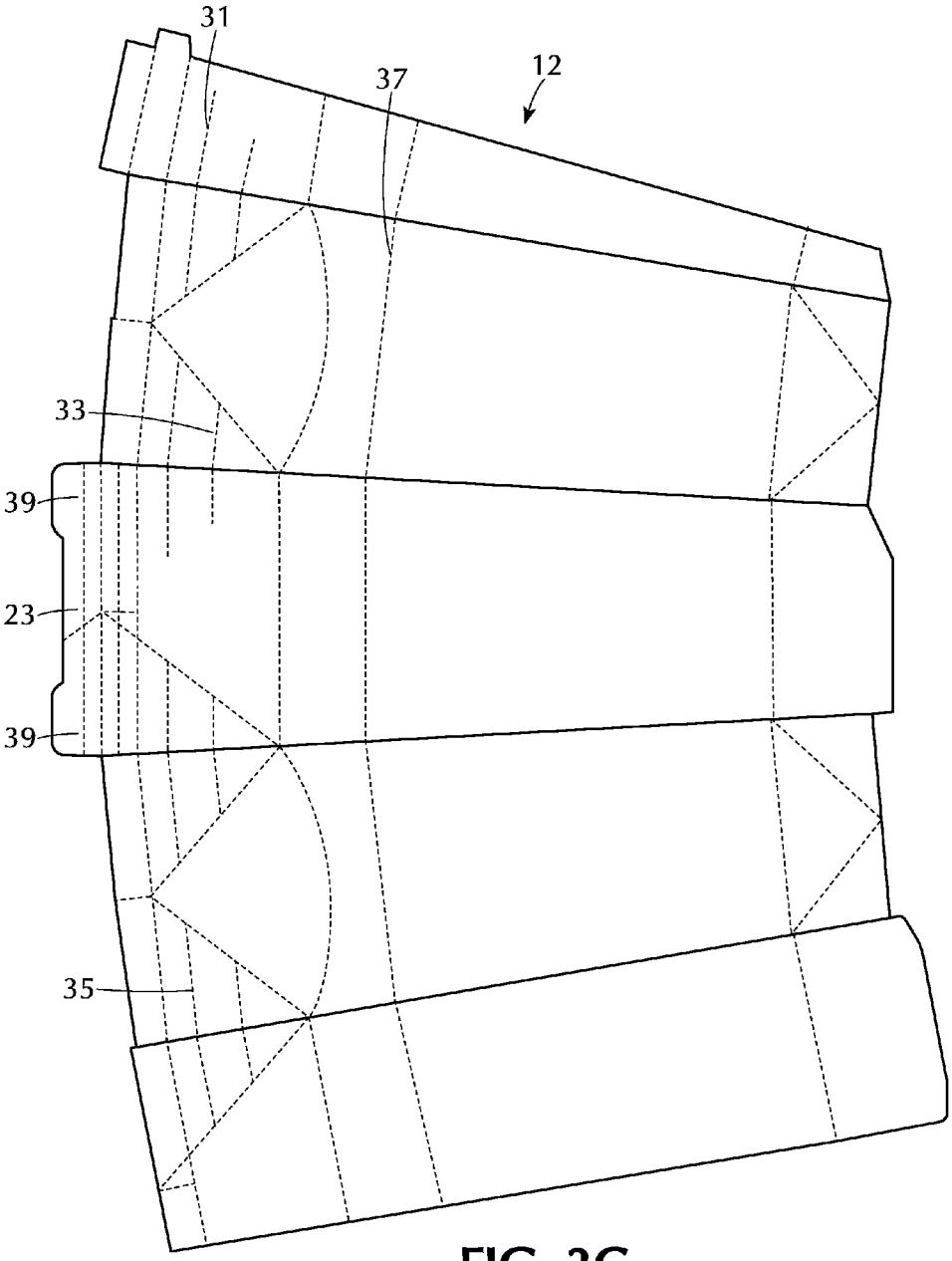
FIG. 3C shows another carton according to an exemplary embodiment of the present invention in an unassembled configuration.

FIG. 3C shows another carton 12 according to an exemplary embodiment of the present invention prior to assembly. The carton 12 has an increased height as compared to the carton 10. In the exemplary embodiment, the tapered side panels have a height of approximately 7 1/32 inches. In the assembled configuration, the width of the side panels is approximately 2.7 to 2.9 inches at the bottom and approximately 3.4 to 3.6 inches at the top.

The increased height allows for an additional volume of liquids or solids in the carton 12. When carton 12 is filled with beer, the increased height also advantageously provides additional volume to accommodate foam generated during the pouring process. As such, a standard volume of beer may be poured without overflowing from the carton 12 during the pouring process. The carton 12 further includes a fill line 37 (e.g., embossed line or detent), visible on the inside and/or outside of the carton 12, to identify a particular volume, such as twelve fluid ounces, sixteen fluid ounces, or twenty-four fluid ounces. In the exemplary embodiment, the file line 37 is approximately 5 13/16 inches from the base. When the fill line is reached, the user may stop pouring and allow the beer to foam above the fill line 37.

The carton 12 also includes a plurality of embossed lines or detents (31, 33, 35) at the top portion. When the container is assembled, the lines or detents abut one another and create an improved seal to prevent liquid from spilling out of the corners of the top portion.

As shown in FIG. 3C, the carton may also include tabs 39 extending from the flap 23 on the top portion of the carton 12. When the flap 23 is folded over or sealed against the top portion of the carton 12, the tabs 39 extend downward and adjacent to the exterior of the gable. As described in more detail below, the tabs 39 cooperate with holes on an accessory handle to carry the carton 12.

Figure 4A:
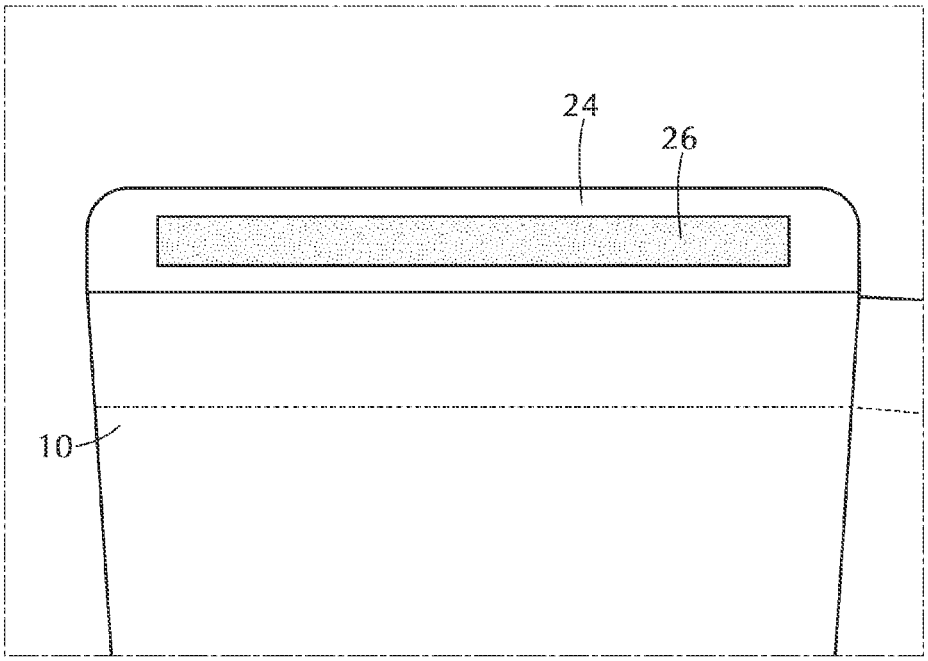
FIG. 4A shows a top portion of a carton according to an exemplary embodiment of the present invention including a sealing strip in an unassembled configuration.

FIG. 4A shows a top portion of a carton 10 in an unassembled configuration in which the flap 22 comprises a sealing strip 24. The sealing strip 24 includes double-sided adhesive or tape affixed to a surface, e.g., a gable panel, on the top portion 20 of the carton 10. The sealing strip 24 further includes a liner or backing 26 removably disposed over the sealing strip 24. After the carton 10 is filled, the backing 26 is removed from the strip 24 by the end user and the flap 22 is stuck down with the open adhesive to seal the carton 10.

The sealing strip 24 allows tamper evidence while the carton remains sealed, yet still allows pressure relief from carbonated beverages due to the fact that the seal is intentionally non-hermetic. In particular, the flap 22 may include small gaps which are not sealed. For example, the sealing strip 24 may have a length less than the length of the flap 22 (e.g., a 3 inch strip and a 4 inch flap) such that there are gaps in the seal at the corners of the flap. In other embodiments, the flap 22 may include unsealed gaps at other locations along the flap 22. For example, the sealing strip 24 may be segmented and comprise several strips with gaps in between.

Figure 4B:
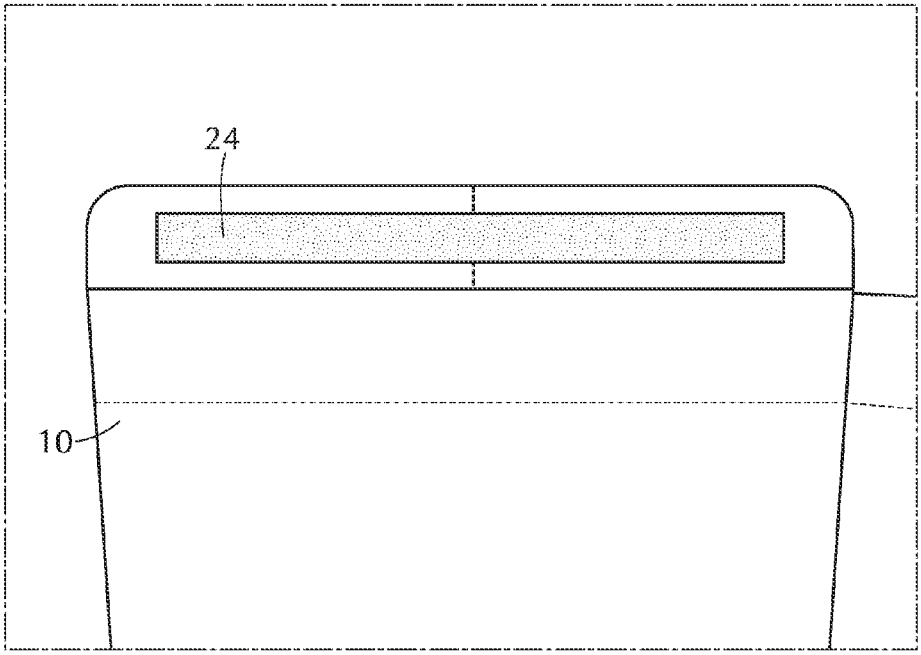
FIG. 4B shows the sealing strip of the carton shown in FIG. 4A prior to use.
Figure 4C:
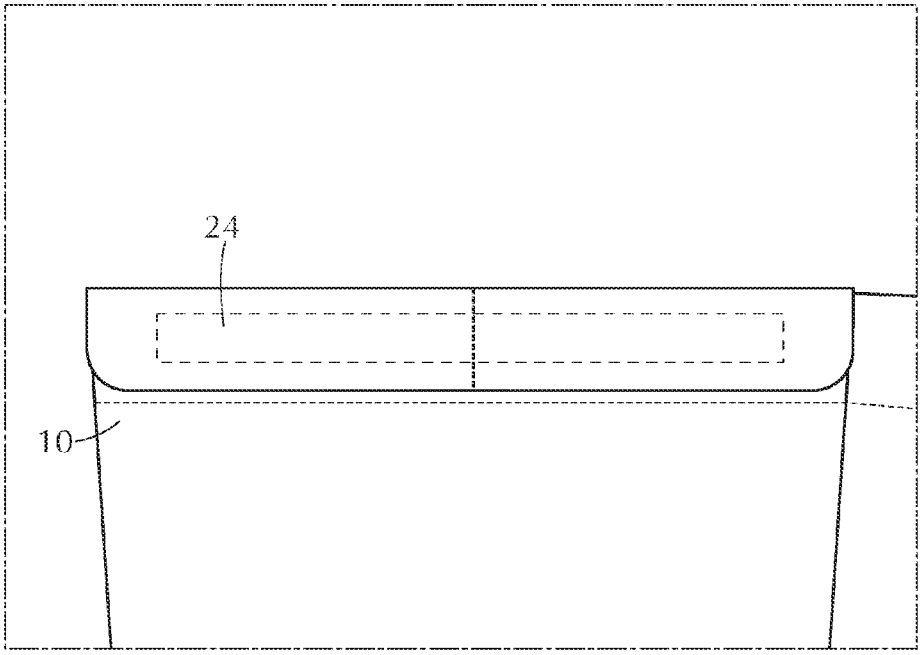
FIG. 4C shows a closed seal on the carton shown in FIG. 4A.

FIGS. 4B and 4C illustrate the process of closing the carton 10 after it is filled. The backing 26 is removed from the sealing strip 24, and the flap 22 is folded over to create a seal. Once the seal is formed, it generally cannot be opened without at least partially damaging the top portion 20 of the carton 10 (see FIG. 4D).

Figure 4D:
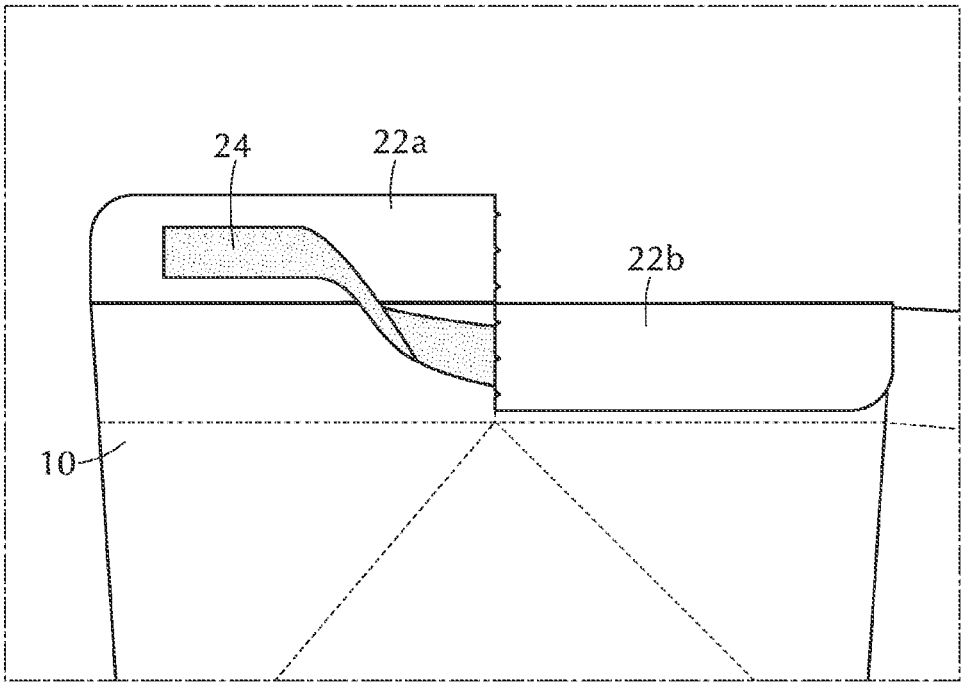
FIG. 4D shows a reopened seal on the carton shown in FIG. 4A.

As shown in FIG. 4D, opening the seal 22 may open the flap 22 of the top portion 20 and/or partially remove the sealing strip 24. In some embodiments, the flap 22 includes a perforation to divide the flap 22 in two pieces, 22*a* and 22*b*. This allows half of the top portion 20 to be opened as a pouring spout. As shown, opening the sealed flap 22 creates irreversible evidence of tamper or destruction showing that the carton 10 has been opened and preventing resealing. This feature is particularly useful for jurisdictions having laws prohibiting an open carton of alcohol. Users can be assured that their carton 10 is sealed, and law enforcement personnel can inspect the carton 10 for tamper evidence to ensure that it has remained closed from the time of purchase.

Figure 5:
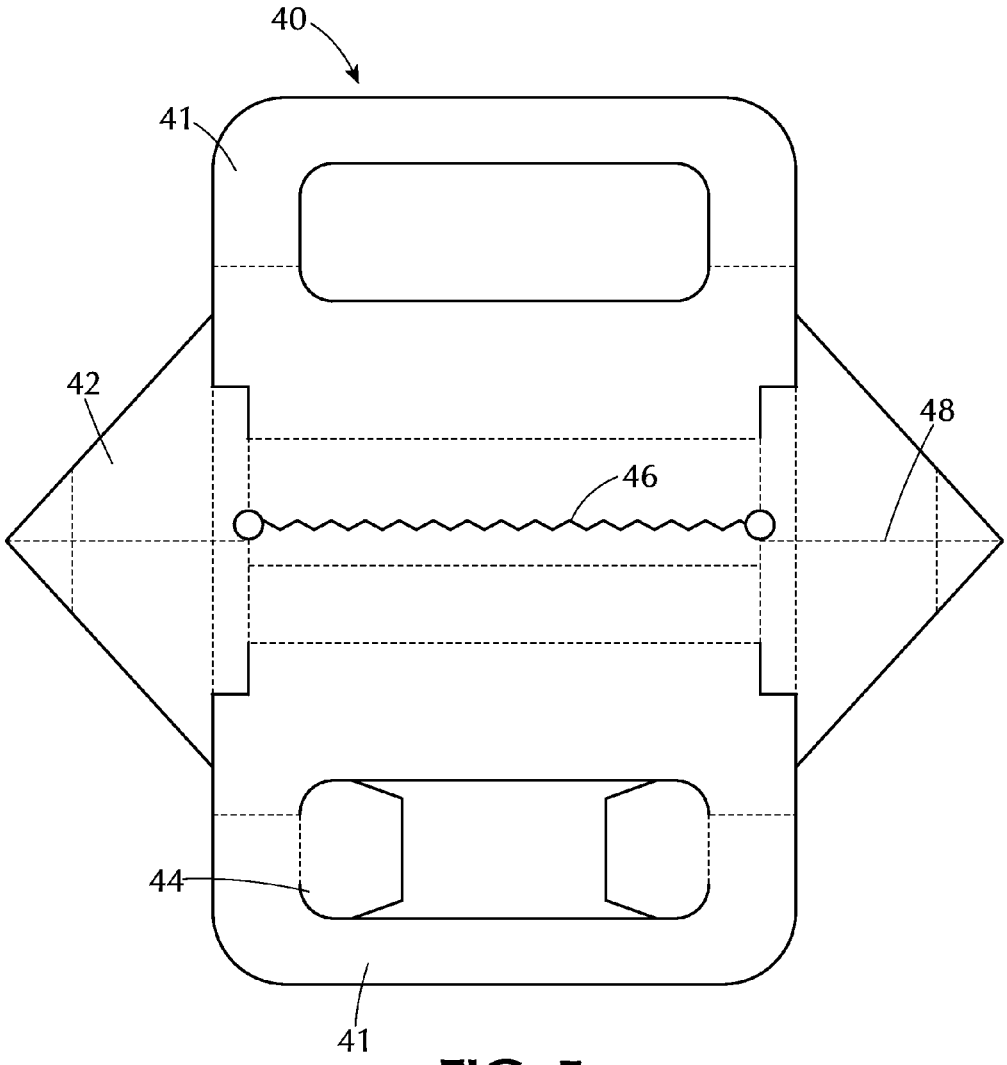
FIG. 5 shows a handle of the carton prior to assembly.

FIG. 5 illustrates a handle 40 for carrying the carton in an unassembled configuration. The handle 40 is made of a foldable material, such as cardboard. The handle includes two handle loops 41. The handle 40 also includes two gable or retaining flaps 42 which fold underneath, and interlock with, the gables 24 at the top portion 20 of the container. The handle 40 further includes two assembly flaps 44 that fold through the opposite handle loop 51 and keep the two sides of the handle together. FIGS. 6A to 6D show the handle installed on a carton 10/12.

Figure 6A:
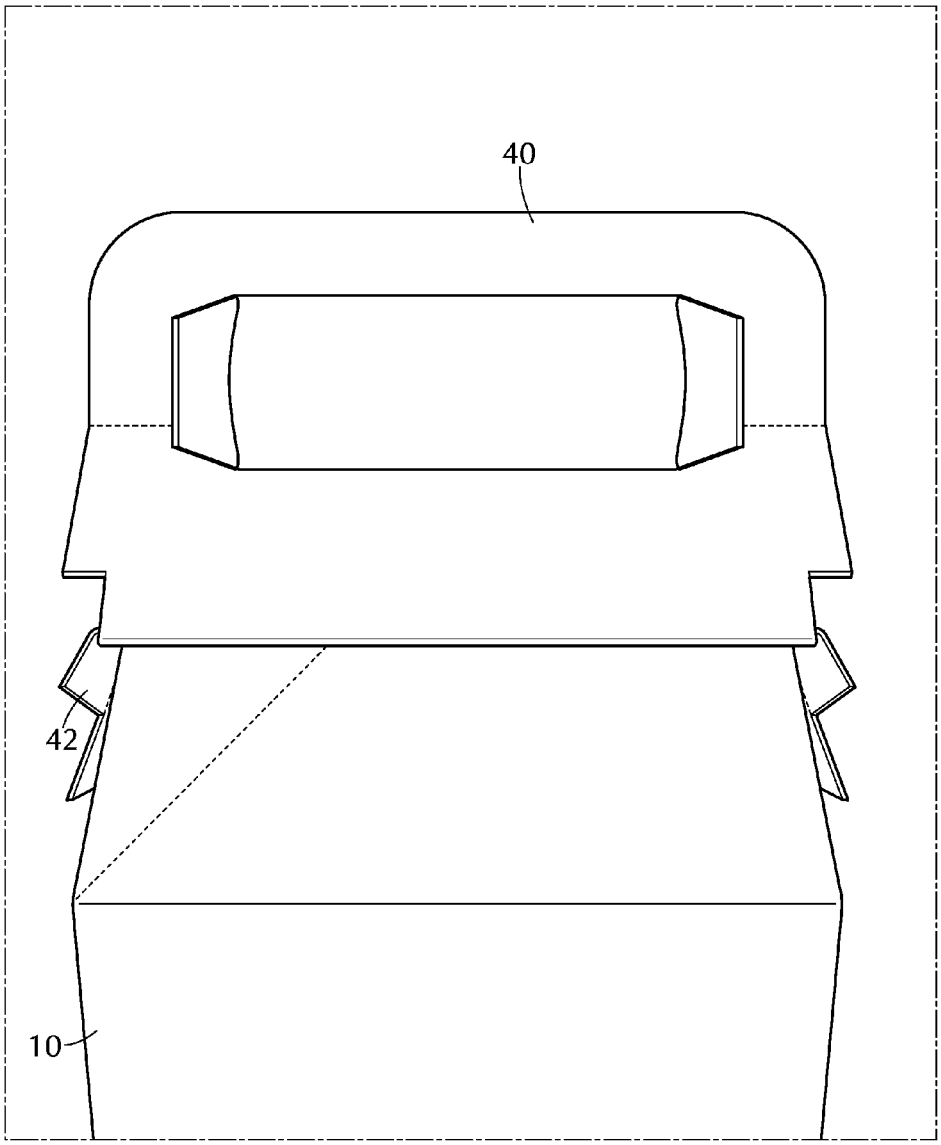
FIGS. 6A to 6D show the handle of FIG. 5 on the carton.
Figure 6B:
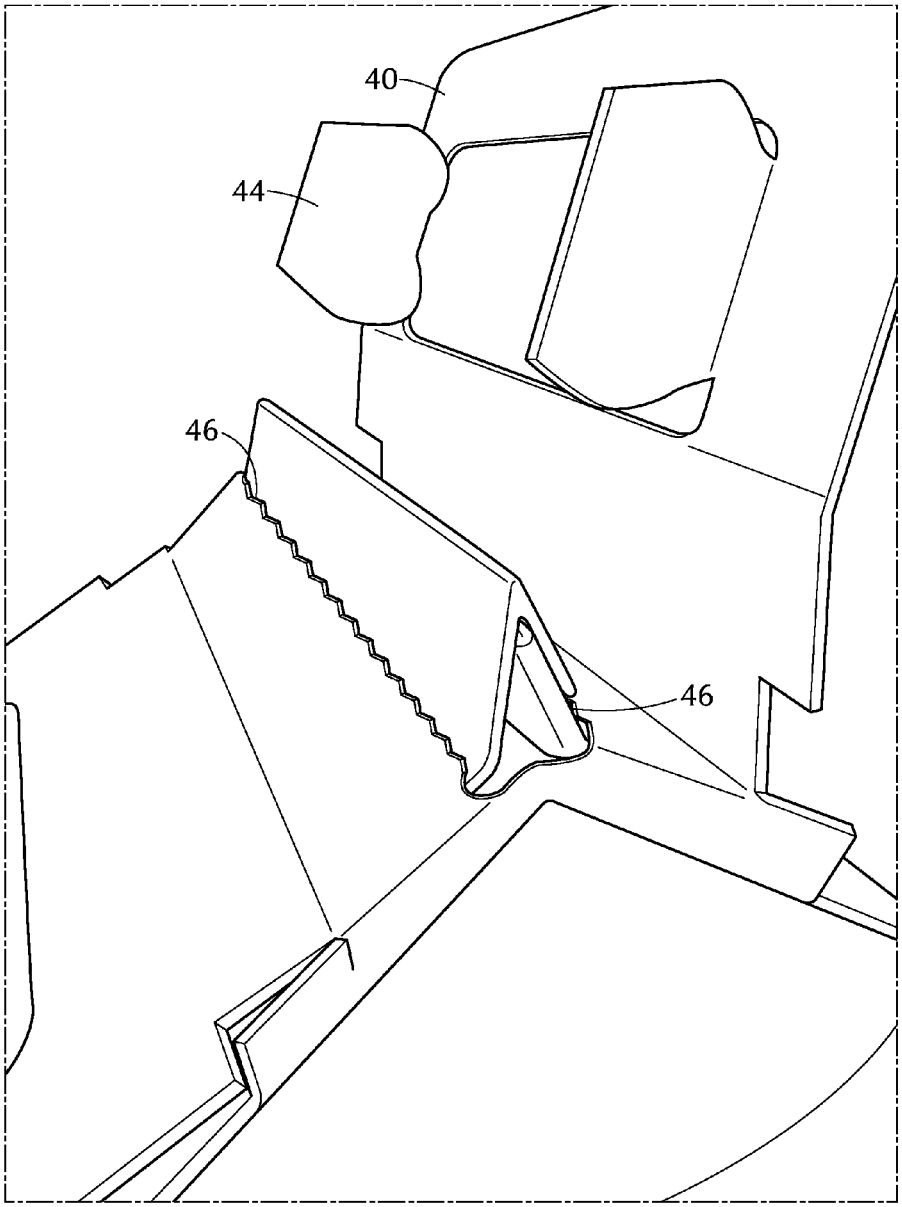
Figure 6C:
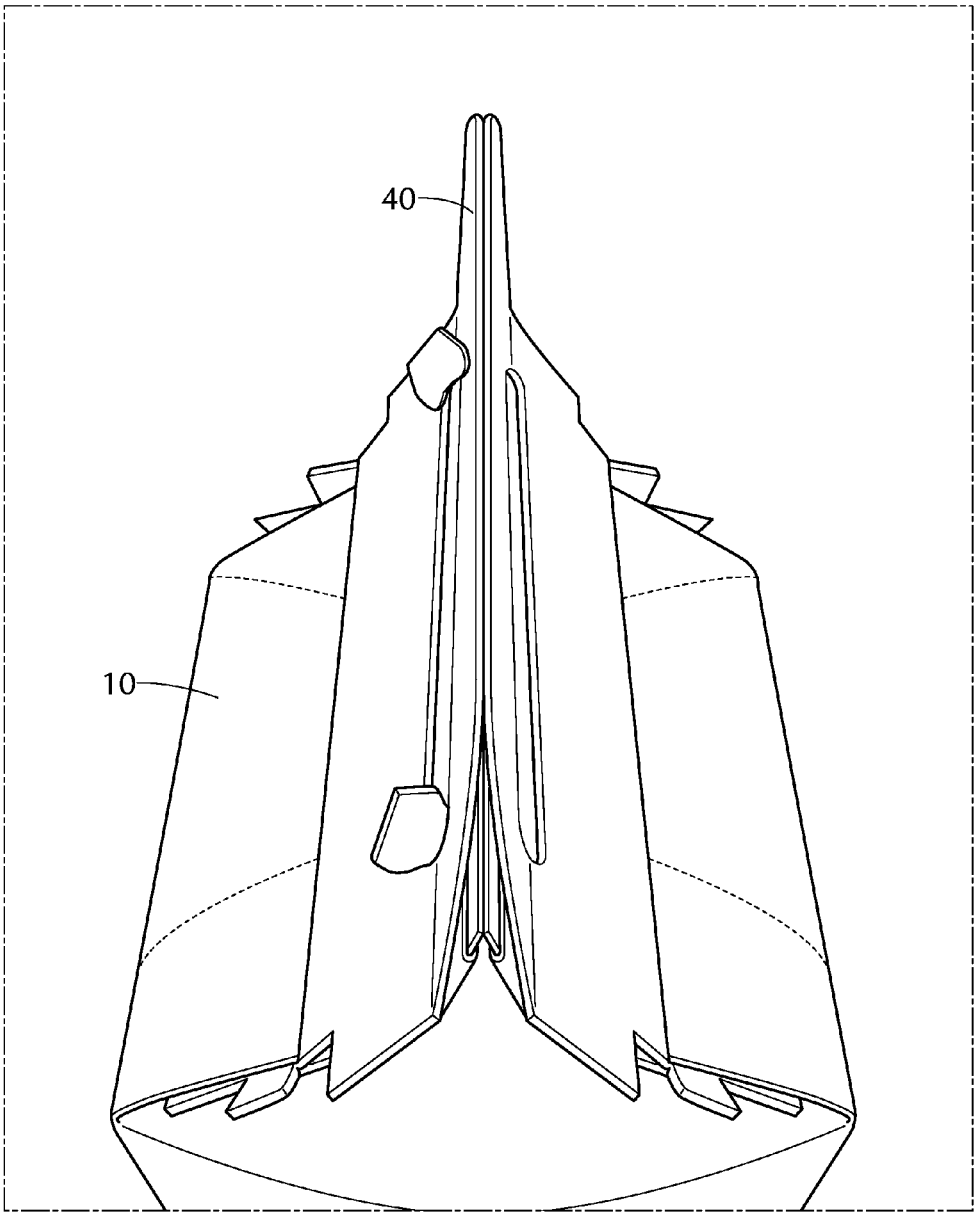
Figure 6D:
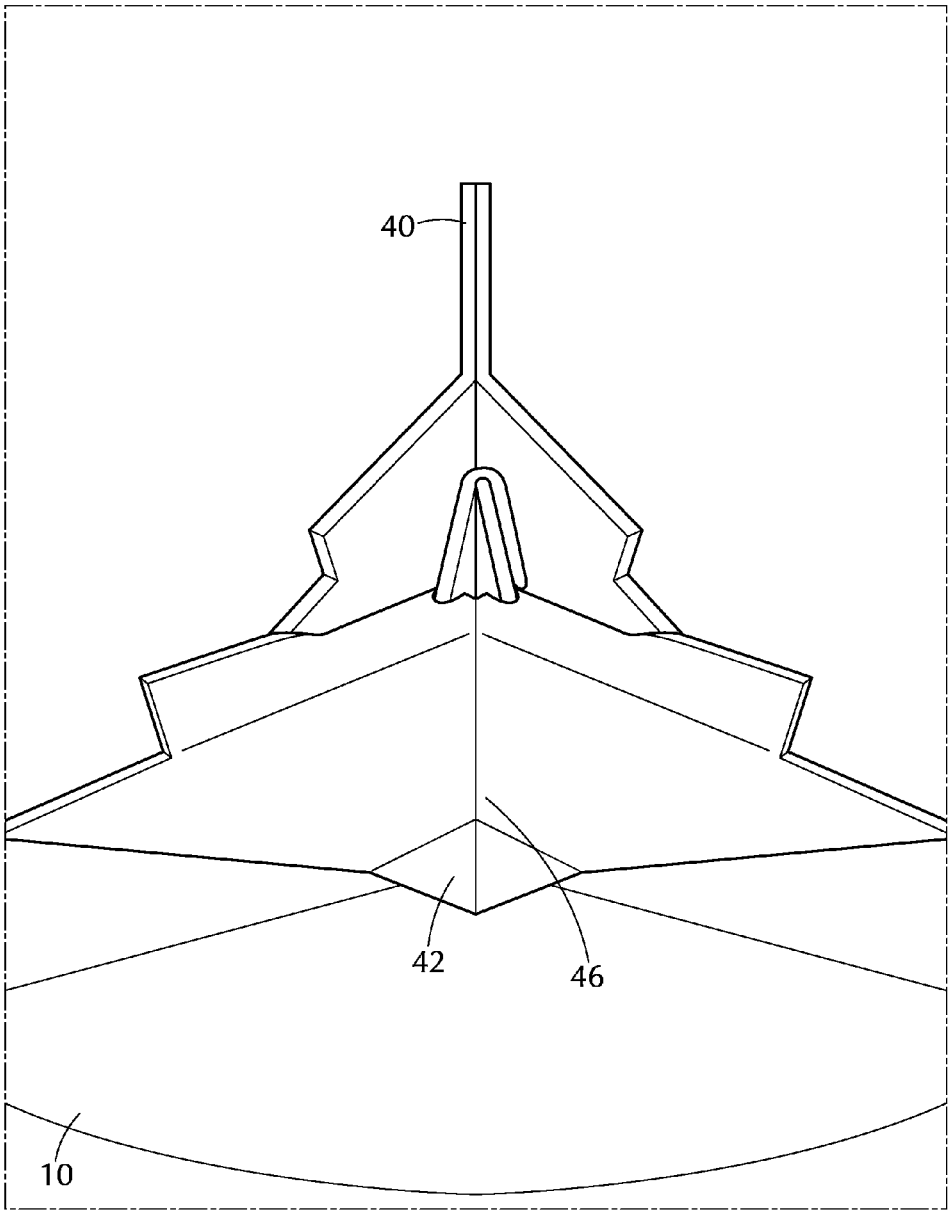

In some embodiments, the handle 40 also includes an opening with serrated edges 46 through which the top portion of container extends (see FIG. 6B). The serrated edges 46 abut the upper end of the top portion 20 of the carton (e.g., below the flap 22) and assist the gable flaps 42 in securing the handle 40 to the carton.

In some embodiments, the gable flaps 42 include a perforated centerline 48 to allow the container to be opened and unsealed with the handle 40 in place. The handle 40 cannot be reassembled after the perforated centerline 48 is broken, which provides another tamper-proof element to the container.

Figure 7:
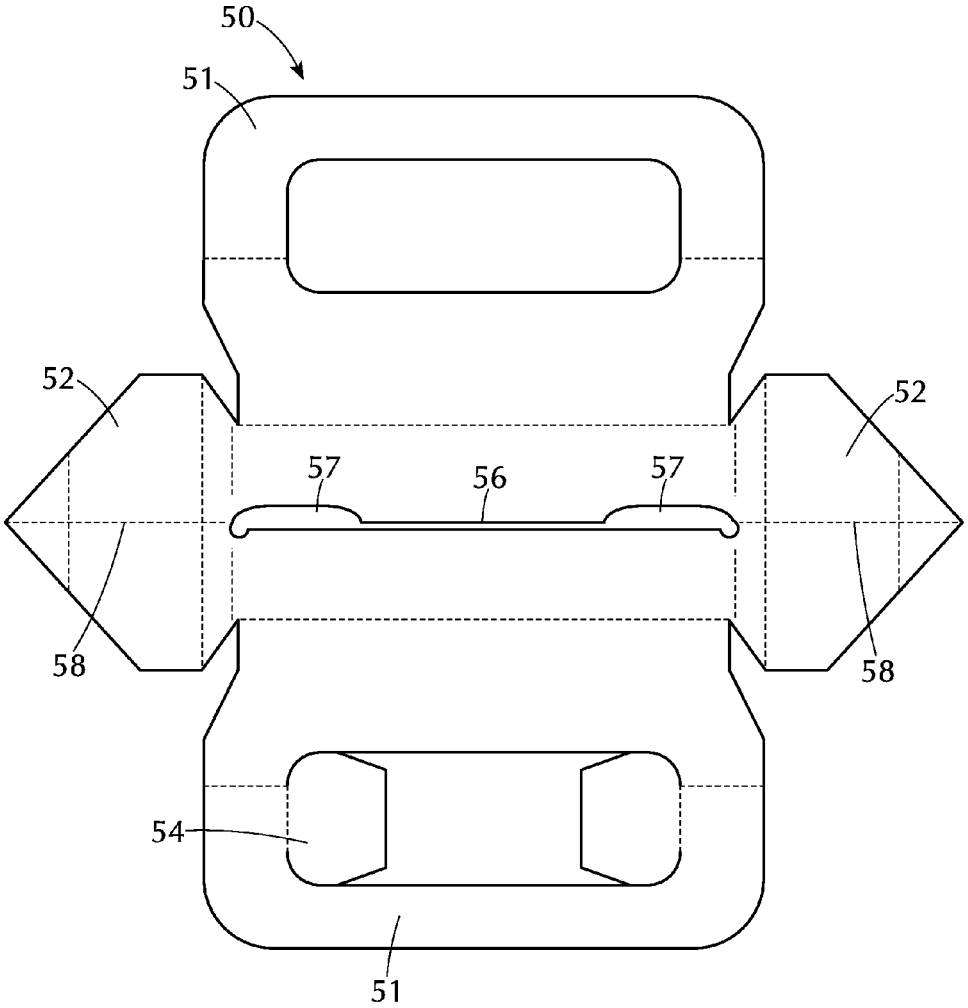
FIG. 7 shows another handle of the carton prior to assembly.

FIG. 7 illustrates another hand 50 for the carton in an unassembled state. The handle 50 is made of a foldable material, such as cardboard. The handle includes two handle loops 51. The handle 50 also includes two gable flaps 52 which fold underneath, and interlock with, the gables 24 at the top portion 20 of the container. The handle 50 further includes two assembly flaps 54 that fold through the opposite handle loop 51 and keep the two sides of the handle together.

Figure 8:
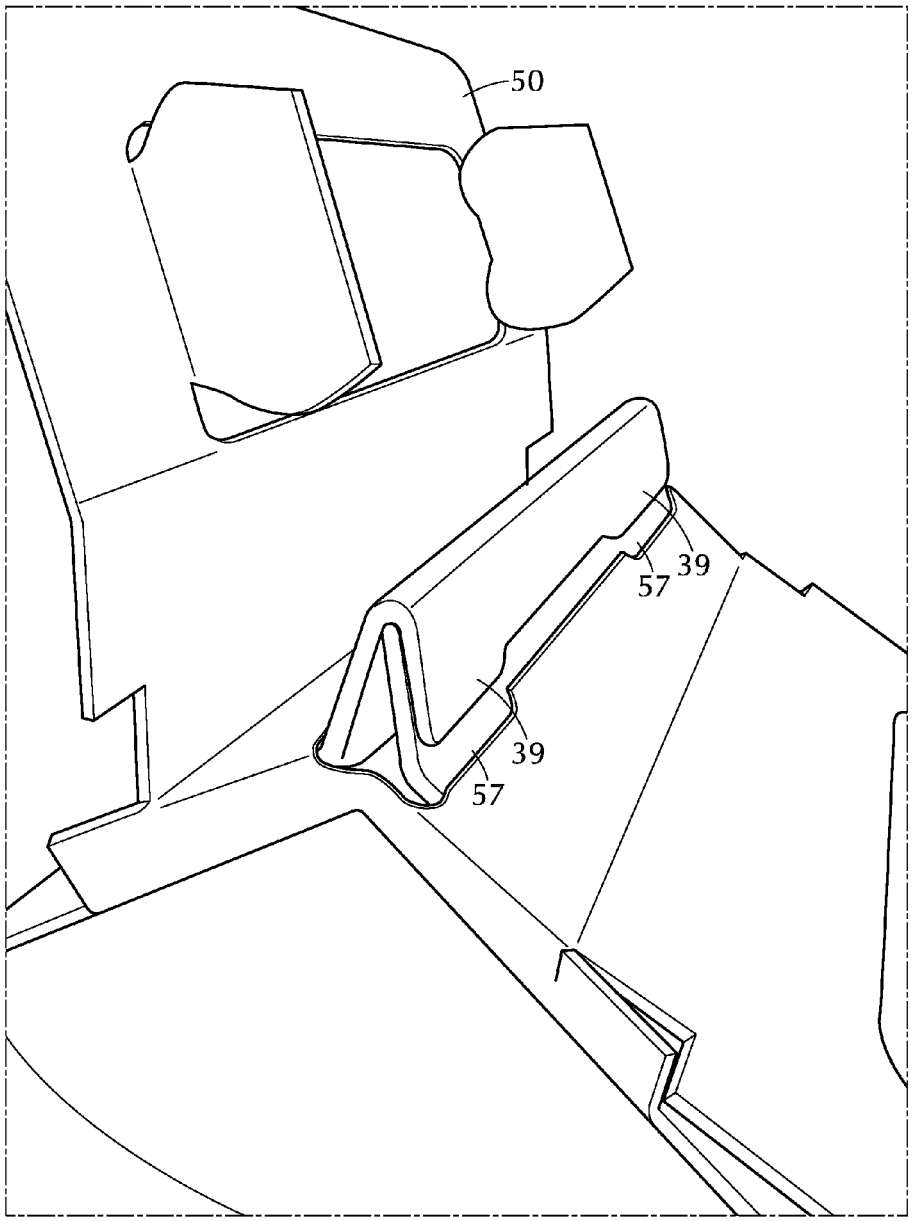
FIG. 8 shows the handle of FIG. 7 on the carton in an opened position.

In the present embodiment, the handle 50 includes an opening 56 through which the top portion of container extends. Along the opening are two holes or cutouts 57. The holes 57 receive the tabs 39 on the carton 12 to assist the gable flaps 52 in securing the handle 50 to the carton. FIG. 8 shows a top inside view of the handle 50, in a partially assembled or opened state, on a carton 10/12 to illustrate how the holes 57 interlock with the tabs 39.

In some embodiments, the gable flaps 52 further include a perforated centerline 58 to allow the container to be opened and unsealed with the handle in place. The handle cannot be reassembled after the perforated centerline 58 is broken, which provides another tamper-proof element to the container.

Figure 9:
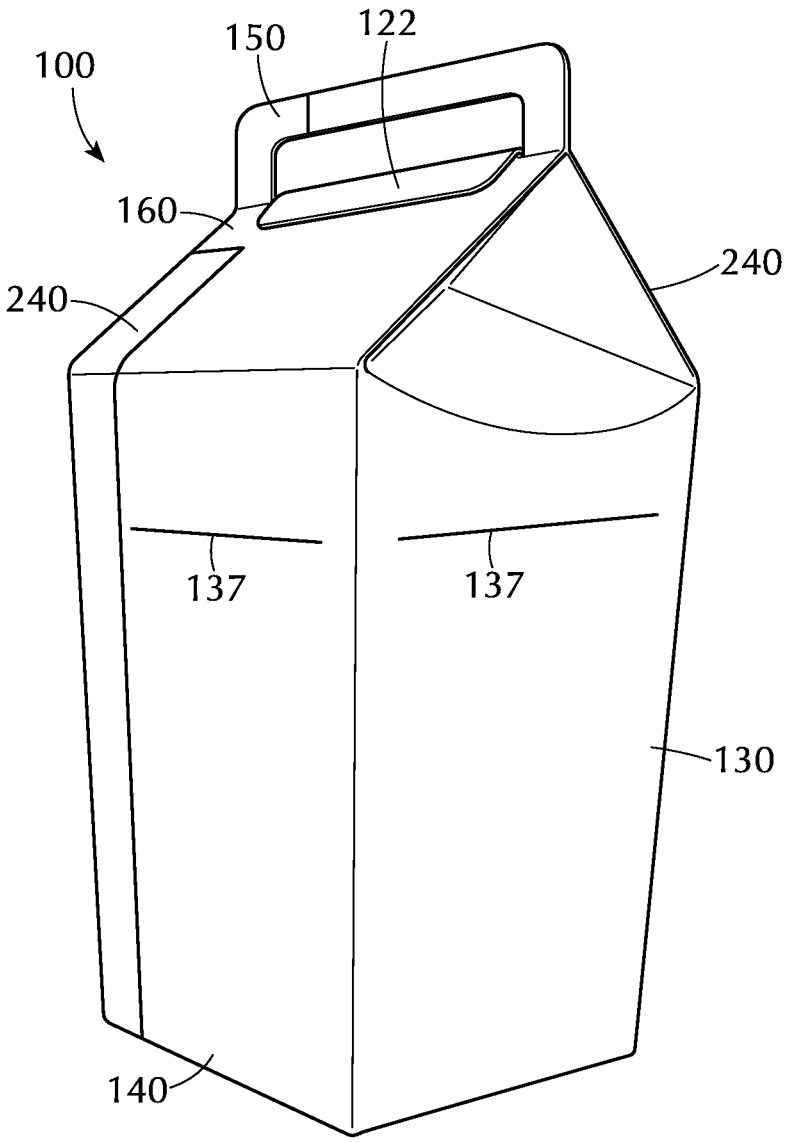
FIG. 9 shows a carton according to an exemplary embodiment of the present invention in an assembled and sealed configuration.
Figure 10:
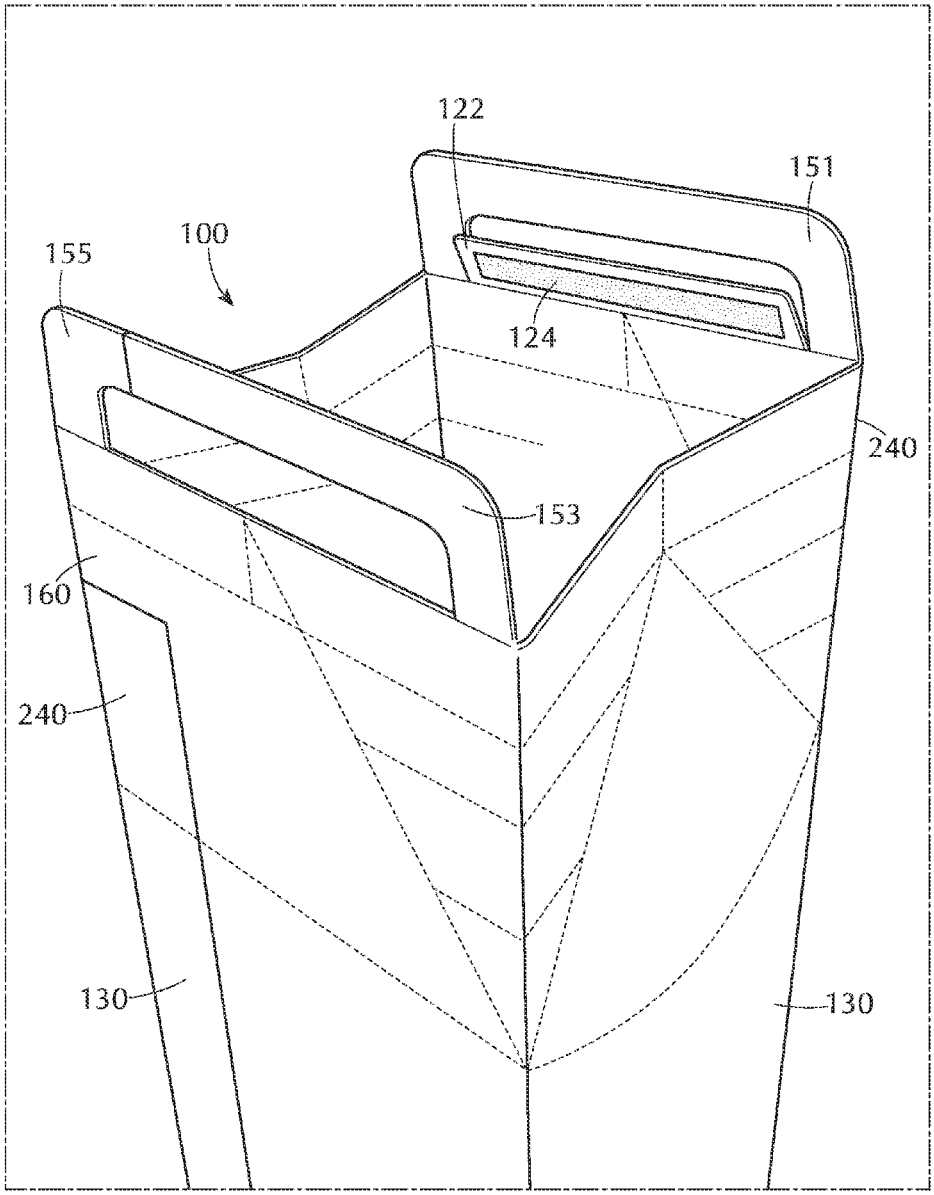
FIG. 10 shows the carton of FIG. 9 in an assembled and open configuration prior to use.
Figure 11:
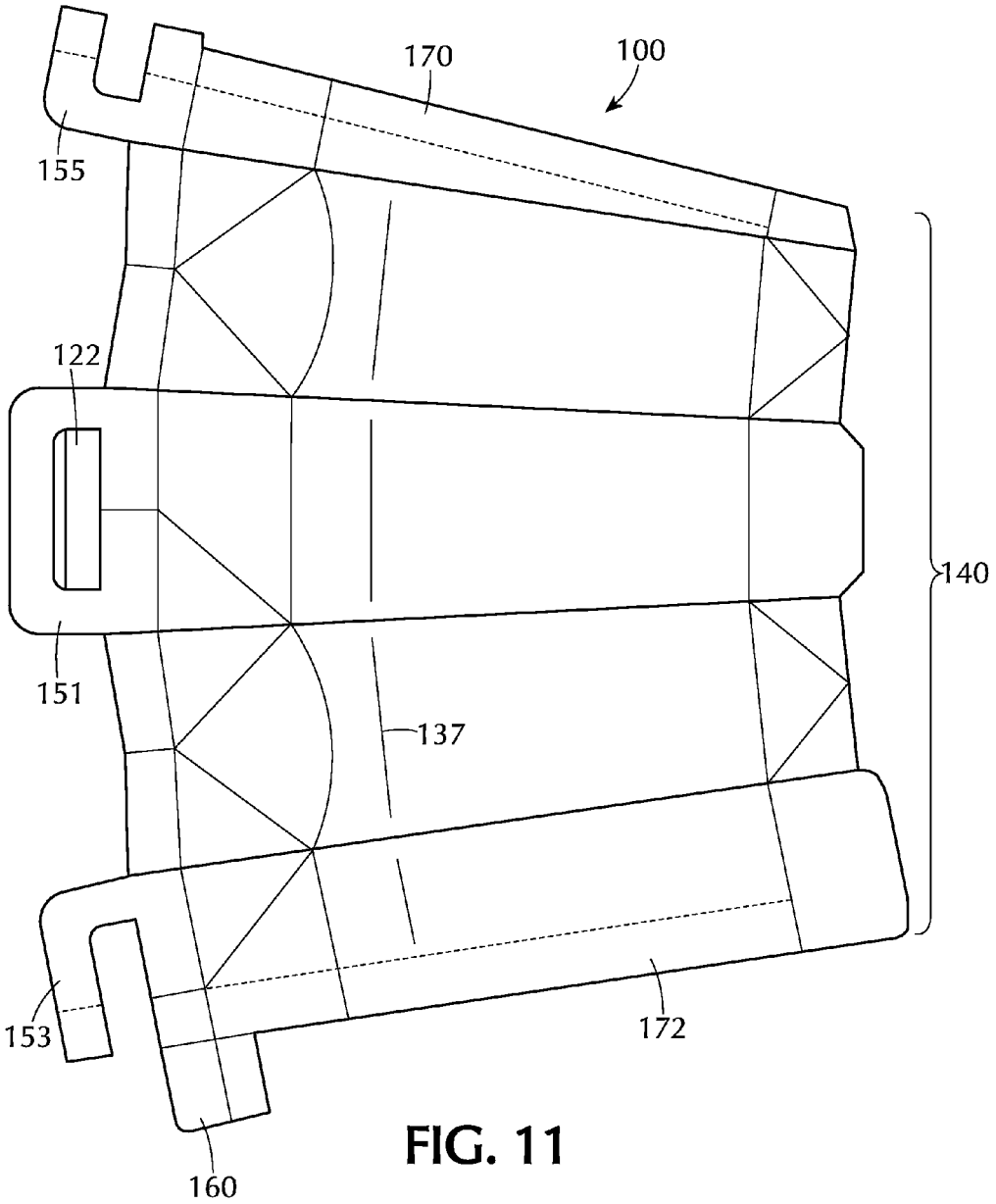
FIG. 11 shows the carton of FIG. 9 in an unassembled configuration.

FIGS. 9 to 11 show another exemplary embodiment of a carton 100 according to the invention. FIG. 9 shows the carton 100 in an assembled and sealed configuration. The carton 100 includes tapered sides 130, a gabled top 240, and a sealed bottom 140. The carton 100 further includes a handle 150. In the present embodiment, the handle 150 is integrated into the top of the carton 100. The carton 100 further includes fill lines 137.

FIG. 10 shows the carton of FIG. 9 in an assembled and open configuration prior to use. The handle 150 includes handle portions 151, 153, and 155. The handle portions extend up and are integrated with the gables 240. The handle portion 151 includes a flap 122 having a tamper-evident seal 124. When the top portion of the carton 100 is closed, as shown in FIG. 9, the flap 122 folds through the handle 150 and seals against the gable 240. As discussed above, when the flap 122 is opened, the seal 124 reveals tamper evidence such as a destruction of the seal 124 and/or damage to the gable 240.

In some embodiments, the carton 100 includes a seal (e.g., such as the seal 124) extending around the entire perimeter of the top portion of the carton. In particular the carton 100 may include double-sided tap or adhesive around the interior of the carton 100 adjacent to the top edge of the gables 240 (below the handle). This provides improved sealing in additional to the seal 124. As with the seal 124, opening of the carton 100 with the full interior seal with reveal tamper evidence around all or at least a portion of the interior perimeter of the top of the carton 100.

FIG. 11 shows the carton of FIG. 9 in an unassembled configuration. The carton 100 is formed by a plurality of panels which are folded together. The base 140 is sealed such that it is watertight and able to retain liquids in the carton 100. Upon assembly, an area 172 is heat sealed against area 170.

Figure 12:
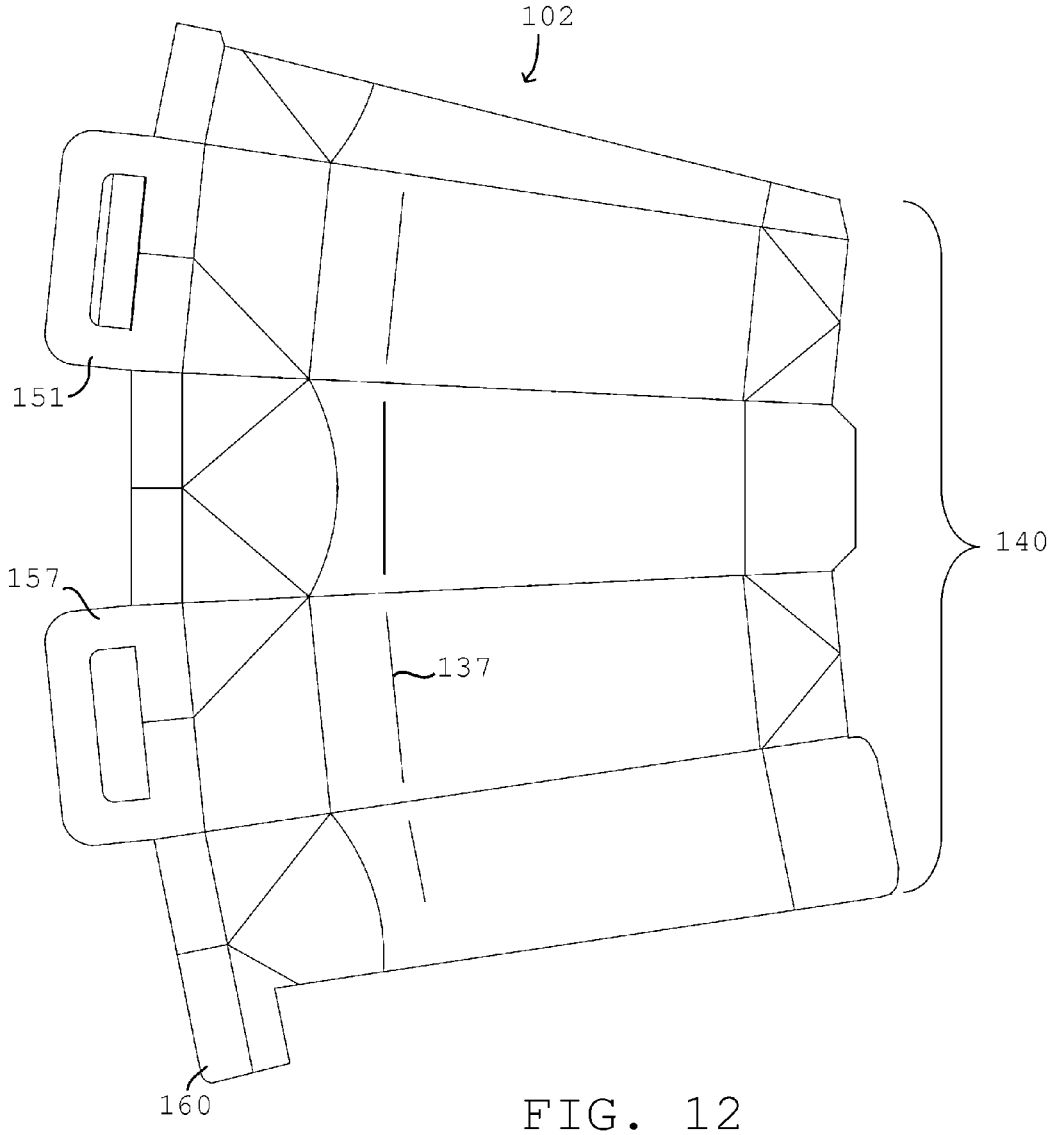
FIG. 12 shows a carton according to an exemplary embodiment of the present invention in an unassembled configuration.

FIG. 12 shows another carton 102 according to an exemplary embodiment of the invention. The carton 102 includes the features of carton 100 but differs in the placement of handle portions 151 and 157. As shown in FIG. 12, the carton 102 may include two complete handle portions 151 and 157 integrated with the carton 102 rather than the handle portions 151, 153, and 155 shown in FIG. 11. As with the carton 100, carton 102 includes a bottom portion 140, a flap 122, and at least one fill line 137.

As shown in FIGS. 9 to 12, the carton 100/102 further includes an extended tab or stop 160. The extended tab 160 rests on the outside of one of the gables 240 once the carton 100/102 is flame sealed. The extended tab 160 is preferably not attached against the surface of the gable 240. However, in some embodiments, the extended tab 160 is heat sealed against the surface of the gable 240 along with the area 172.

The extended tab 160 has a thickness (e.g., of several millimeters) which creates an edge or abutment between the lower edge of the extended tab 160 and the surface of the gable 240. The carton 100 may be stacked within other cartons 100/102. During stacking, the extended tab 160 acts as a block or stop to limit the depth of stacking and/or prevent the cartons 100/102 from stacking too deeply into one another. This prevents vacuum and allows the cartons to be easily dispensed.

Figure 13:
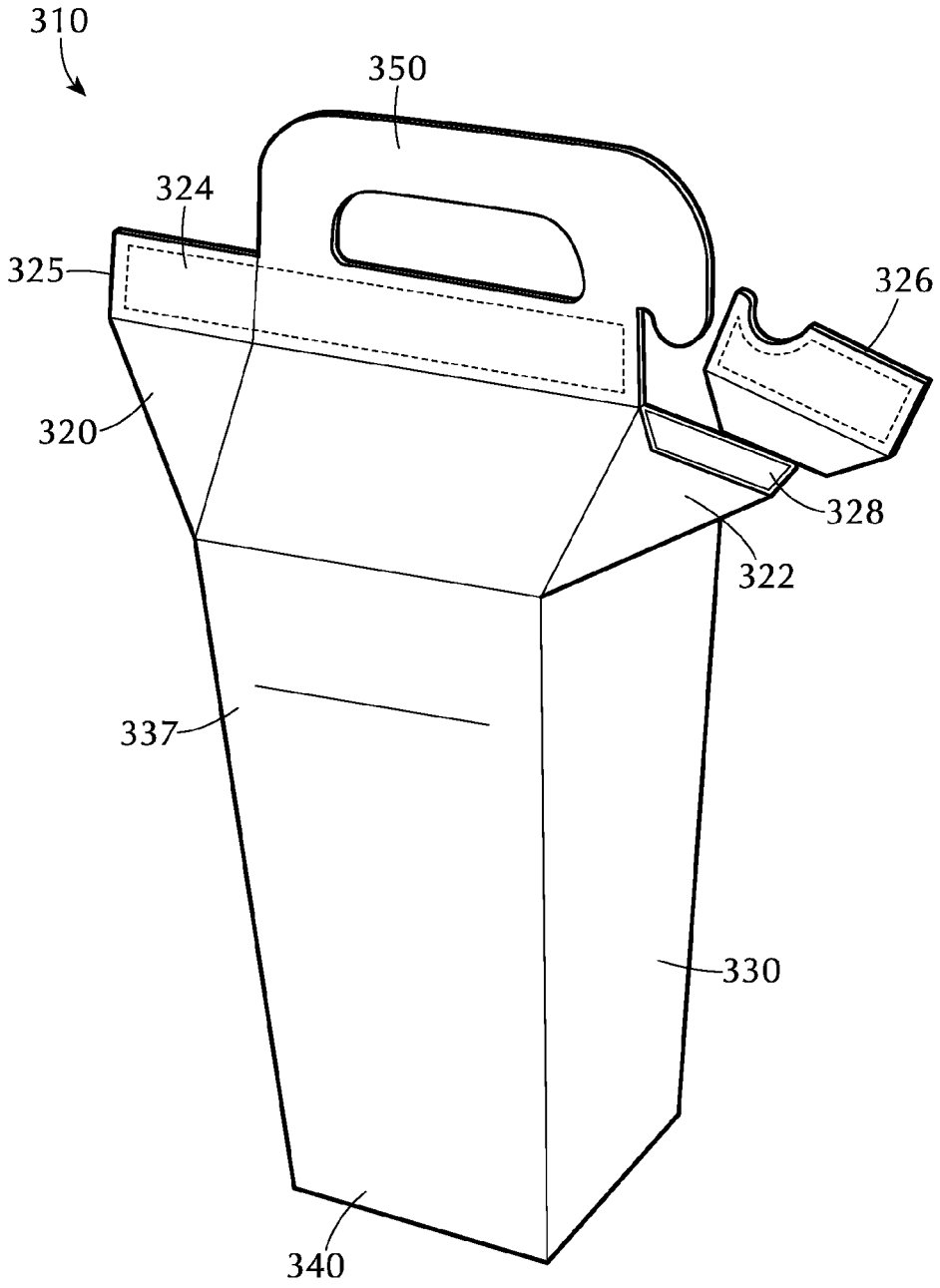
FIG. 13 shows a carton according to an exemplary embodiment of the present invention in an assembled and sealed configuration.
Figure 14:
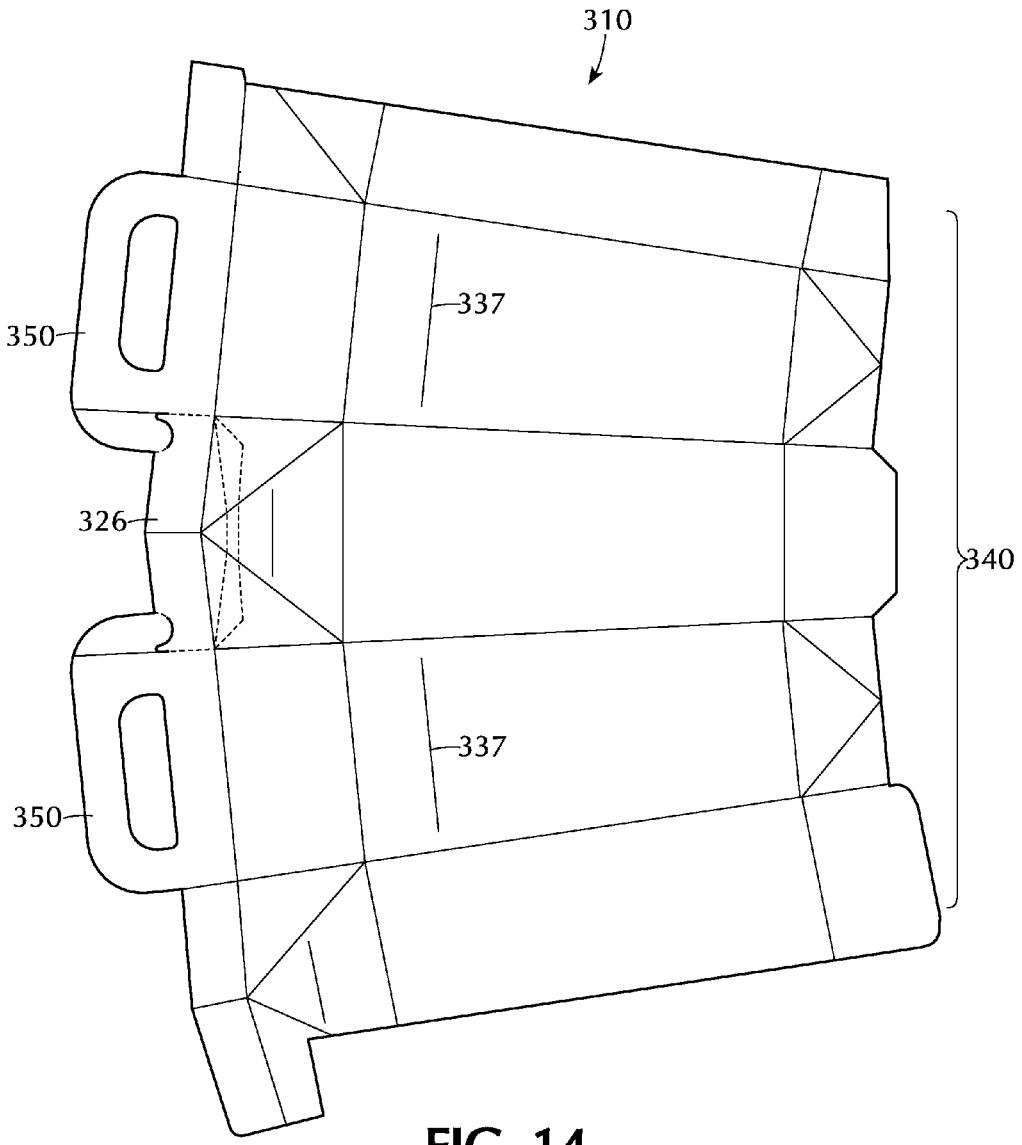
FIG. 14 shows the carton of FIG. 13 in an unassembled configuration.

FIG. 13 shows another carton 310 according to an exemplary embodiment of the present invention in an assembled and sealed configuration. FIG. 14 shows the carton 310 in an unassembled configuration. The carton 310 includes a top portion including two outwardly extending gables 320/322, having exterior panels and interior panels, and an integrated handle 350. The carton 310 also includes four upwardly tapered side panels 330 and a sealed base 340. The carton 310 may also include one or more fill lines 337.

As with the embodiments discussed above, the carton 310 may be partially assembled in an open configuration prior to use (see FIG. 10). After filling the carton 310, the gables 320/322 are folded outward and sealed against one another using a sealing strip 324. The carton 310 may then be transported with the contents enclosed. The sealing strip 324 may extend around the entire opening of the carton 310 and provides tamper evidence while the carton 310 remains sealed.

The carton 310, with its outwardly folded gables 320/322, provides for improved sealing and enables easy opening of the carton 310. In particular, one of the gables 322 includes a tear-away section 326 (e.g., separable by perforations) which can be removed to open the carton 310 and create a spout. The tear-away section 326 includes part of the top sealing edge 325 of the carton 310 and parts of the angled gable 322 such that removal of the tear-away section 326 creates an opening 328. Opening of the carton 310 via the tear-away section 326 (or elsewhere along the sealing strip 324) creates irreversible evidence of tamper or destruction showing that the carton 310 has been opened and preventing resealing.

Although the invention has been described with reference to a particular arrangement of parts, features and the like, these are not intended to exhaust all possible arrangements or features, and indeed many modifications and variations will be ascertainable to those of skill in the art.

What is claimed is:

1. A carton for transporting and dispensing liquid-based materials, comprising:

a sealed base;

a plurality of upwardly tapered sides;

a top portion configured to adopt an open configuration for filing the carton and a closed configuration for transporting the liquid-based materials, said top portion including a top sealing edge and two gables extending outward from the carton in the closed configuration;

a seal extending around an interior of the top sealing edge, said seal revealing tamper evidence upon opening of said top portion of the carton from the closed configuration;

a handle integrated with the top sealing edge and comprising two handle loops; and a tear-away portion comprising a portion of the top sealing edge and a portion of one of the gables, said tear-away portion separable from said container by perforations to create an opening for dispensing the liquid-based materials.

2. The carton according to claim 1, wherein the carton is stackable within a second carton in the open configuration, wherein the carton further comprises a tab on an exterior surface of at least one of the gables, said tab providing a block to limit the depth to which said carton stacks within the second carton.

3. The carton according to claim 1, wherein the carton further comprises at least one fill line on at least one of the tapered sides.

4. The carton according to claim 3, further comprising a volume above the file line to accommodate foam during filing of the carton.

5. The carton according to claim 1, wherein the seal comprises adhesive tape.

6. The carton according to claim 1, wherein the top portion includes a plurality of foldable panels, wherein two or more of the panels and the gables include embossed lines which interact with one another to create seals.

7. The carton according to claim 1, wherein the carton comprises a biodegradable cardboard material.

8. The carton according to claim 1, wherein the carton is made of a cardboard material with a polyethylene coating on an inside surface of the carton.

9. A carton for transporting and dispensing liquid-based materials, comprising:

a sealed base;

a plurality of upwardly tapered sides;

a top portion comprising a gable top and a sealing portion to close said top portion, the sealing portion including a perforation to permit the top portion to be opened;

a tamper-proof seal on the sealing portion, said seal revealing tamper evidence upon opening of said top portion of the carton;

at least one fill line on at least one of the tapered sides; and a handle integrated with said top portion comprising two handle loops;

wherein the sealing portion is a flap that folds over an exterior surface of the top portion so that said seal is formed on the exterior surface.

10. The carton according to claim 9, wherein the flap extends through each of the two handle loops upon sealing of said carton.

11. The carton according to claim 10, wherein the flap includes the perforation extending through a center of the flap.

12. The carton according to claim 10, further comprising a second tamper-proof seal extending around an interior top edge of said top portion.

13. The carton according to claim 9, wherein the top portion includes a plurality of foldable panels, wherein two or more of the panels and the gables include embossed lines which interact with one another to create seals.

14. The carton according to claim 9, wherein said carton is stackable within a second carton, wherein said carton further comprises a tab on an exterior surface of at least one of the gables, said tab providing a block to limit the depth to which said carton stacks within the second carton.

15. The carton according to claim 9, wherein a first one of the handle loops is integrated with a first side of the gable top and a second one of the handle loops is integrated with a second side of the gable top.

16. The carton according to claim 9, wherein the gable top includes two gables extending outward from the carton in a closed configuration.

17. The carton according to claim 16, further comprising a tear-away portion comprising a portion of the sealing portion and a portion of one of the gables, said tear-away portion separable from said container by the perforation to create an opening for dispensing the liquid-based materials.

18. The carton according to claim 9, further comprising a volume above the file line to accommodate foam during filing of the carton.

19. The carton according to claim 9, wherein the carton comprises a biodegradable cardboard material.

20. The carton according to claim 9, wherein the carton is made of a cardboard material with a polyethylene coating on an inside surface of the carton.

* * * * *